US006557282B1

(12) United States Patent
Cleaver

(10) Patent No.: US 6,557,282 B1
(45) Date of Patent: May 6, 2003

(54) PORTABLE ILLUMINATED OUTDOOR ADVERTISING DISPLAY

(75) Inventor: Mark J. Cleaver, Wilmette, IL (US)

(73) Assignee: Ilight Technologies, Inc., Evanston, IL (US)

( * ) Notice: Subject to any disclaimer, the term of this patent is extended or adjusted under 35 U.S.C. 154(b) by 0 days.

(21) Appl. No.: 10/062,802

(22) Filed: Jan. 31, 2002

Related U.S. Application Data

(60) Provisional application No. 60/266,351, filed on Feb. 2, 2001.

(51) Int. Cl.[7] ..... G09F 13/00

(52) U.S. Cl. ..... 40/541; 40/552; 40/605; 40/624

(58) Field of Search ..... 40/541, 605, 618, 40/622, 624, 552, 564

(56) References Cited

U.S. PATENT DOCUMENTS

| | | | | | |
|---|---|---|---|---|---|
| 2,923,080 | A | * | 2/1960 | Spangler | 40/552 |
| 3,634,960 | A | * | 1/1972 | Don Carlos | 40/624 |
| 3,987,567 | A | * | 10/1976 | Fritts | 40/624 |
| 4,000,573 | A | * | 1/1977 | Cohen | 40/622 |
| 4,532,579 | A | * | 7/1985 | Merryman | 40/552 |
| 4,891,896 | A | | 1/1990 | Boren | |
| 4,976,057 | A | | 12/1990 | Bianchi | |
| 5,151,679 | A | | 9/1992 | Dimmick | |
| 5,365,411 | A | | 11/1994 | Rycroft et al. | |
| 5,410,453 | A | | 4/1995 | Ruskouski | |
| 5,416,679 | A | | 5/1995 | Ruskouski et al. | |
| 5,459,955 | A | | 10/1995 | Ruskouski et al. | |
| 5,526,236 | A | | 6/1996 | Burnes et al. | |
| 5,588,236 | A | | 12/1996 | Suzuki | |
| 5,613,751 | A | | 3/1997 | Parker et al. | |
| 5,618,096 | A | | 4/1997 | Parker et al. | |
| 5,640,792 | A | | 6/1997 | Smith et al. | |
| 5,842,297 | A | | 12/1998 | Tung | |
| 5,876,107 | A | | 3/1999 | Parker et al. | |
| 5,887,968 | A | | 3/1999 | Logan | |
| 5,921,652 | A | | 7/1999 | Parker et al. | |
| 5,950,340 | A | | 9/1999 | Woo | |
| 5,996,263 | A | | 12/1999 | Black | |
| 6,023,869 | A | | 2/2000 | Durbin | |
| 6,042,248 | A | | 3/2000 | Hannah et al. | |
| 6,076,294 | A | | 6/2000 | Durbin | |
| 6,079,838 | A | | 6/2000 | Parker et al. | |
| 6,305,110 | B1 | * | 10/2001 | Chang | 40/552 |

* cited by examiner

*Primary Examiner*—Gary Hoge
(74) *Attorney, Agent, or Firm*—Stites & Harbison, PLLC; Vance A. Smith; David W. Nagle, Jr.

(57) ABSTRACT

A portable illuminated outdoor advertising display comprises a plurality of modules, a portion of which are removably secured to said frame structure, collectively forming a matrix of modules when juxtaposed adjacent one another in predetermined positions on a surface of the frame structure. An illumination device is secured to at least one of the modules such that the surface of the matrix together with said illumination device forms a visually apparent indicia or a design when the modules are in said predetermined positions.

8 Claims, 4 Drawing Sheets

PORTABLE ILLUMINATED OUTDOOR ADVERTISING DISPLAY

CROSS-REFERENCE TO RELATED APPLICATIONS

The present application claims priority from U.S. Provisional Application Serial No. 60/266,351 filed Feb. 2, 2001, the entire disclosure of which is incorporated herein by reference.

BACKGROUND OF THE INVENTION

The present invention relates to an outdoor advertising display and, more particularly, to an outdoor advertising display using neon-like illumination that can be assembled, disassembled, and reassembled in different locations.

Although outdoor advertising billboards have begun to employ neon accents for eye-catching displays in special situations, such billboards have limited commercial appeal due to the inherent nature of the advertising apparatus and costs involved. Specifically, neon lighting is subject to frequent breakdown and thus requires constant and consistent maintenance. Furthermore, operating costs are high due to the electrical consumption of the neon lighting. Lastly, relocating and using such outdoor advertising billboards at other and different locations is often impossible due to the very heavy weight involved and the fragile nature of the neon lighting apparatus. In short, the costs associated with such displays can be justified only if the displays are maintained and kept at a particular site for long lengths of time.

It is apparent that lightweight illuminated advertising displays that can be easily assembled, disassembled, and reassembled at other locations when desired would go a long way toward addressing the shortcomings described above. It would be particularly desirable that such advertising displays be resistant to breakage and have lower energy operating costs.

It is therefore a paramount object of the present invention to provide an outdoor advertising display using neon-like illumination that can be assembled, disassembled, and reassembled in different locations.

This and other objects and advantages of the present invention will become apparent upon a reading of the following description.

SUMMARY OF THE INVENTION

The present invention addresses the above object of providing a portable illuminated outdoor advertising display that is adapted to be secured to a frame structure of a billboard. The preferred display generally comprises a plurality of modules, a portion of which are removably secured to the frame structure and collectively forming a matrix of modules when juxtaposed adjacent one another in predetermined positions along a surface of the frame structure. At least one lightweight neon-like illumination device is preferably secured to one or more of the modules and forms a visually apparent indicia or a design when the modules are positioned in the matrix.

DETAILED DESCRIPTION OF THE PREFERRED EMBODIMENT

Figure 1:
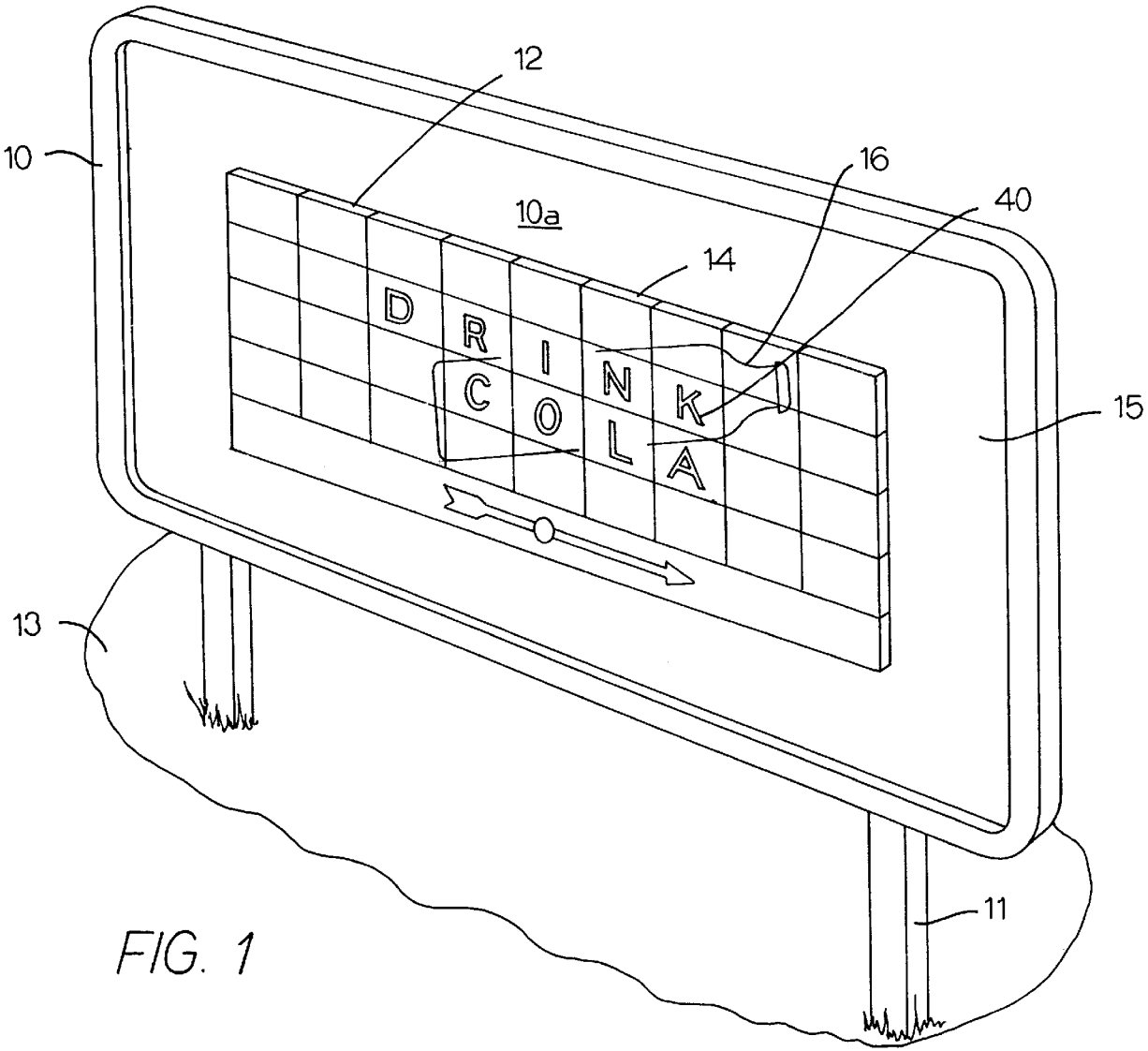
FIG. 1 is a perspective view of a billboard structure supporting a detachable and portable illuminated modular advertising display in accordance with the present invention.

The billboard 10 illustrated in FIG. 1 is typically constructed of a material suitable to withstand the effects of adverse weather conditions and is considered to be a substantially permanent fixture on supports 11 amply secured to an underlying ground surface 13. Prior art billboard constructions typically include material bearing advertising indicia or designs which are adhered to the front surface 10*a* of the billboard. Generally, the material is in the form of strips of paper or other substantially flat material that is laid out in a predetermined pattern so as to correctly form the total advertising display. For those displays incorporating neon lighting, the lighting fixtures, including appropriate accessories (collectively referred to as the "neon lighting apparatus"), are secured to the billboard 10. As described above, the cost of creating such advertising displays are significant and cannot be justified unless long-term advertising at that location is desired. Indeed, relocating and using such outdoor advertising billboards at other and different locations is often impossible due to the weight and fragile nature of the neon lighting apparatus.

However, in the preferred embodiment of the present invention depicted in FIG. 1, the advertising display is actually mounted on a surface of a matrix (generally indicated by reference numeral 15) comprised of a multiplicity of independent modules 12, each of which is detachably secured to the support surface 10*a* surface of the billboard 10.

Figure 2:
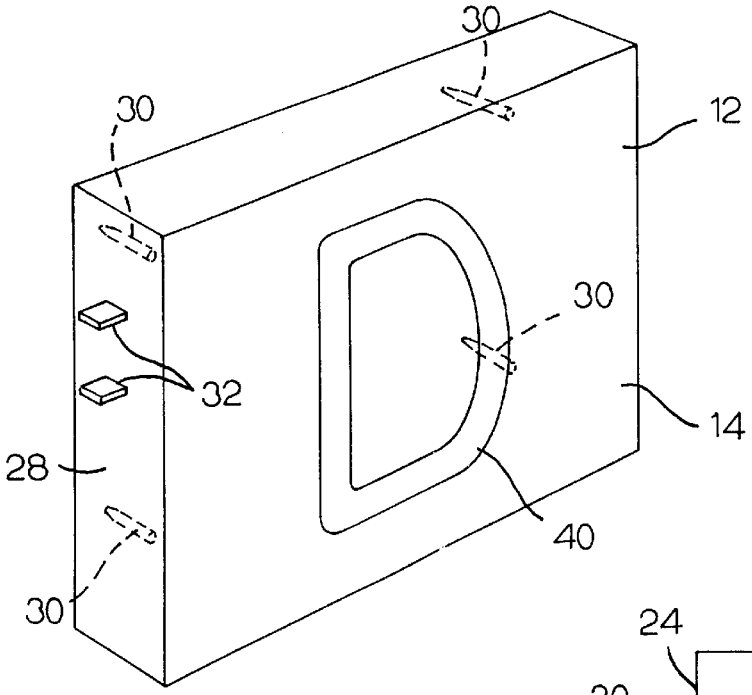
FIG. 2 is a perspective view of a single module of the advertising display of FIG. 1.
Figure 3:
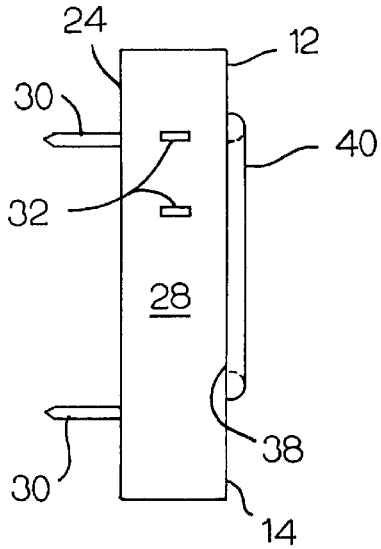
FIG. 3 is a side view of the module of FIG. 2.
Figure 4:
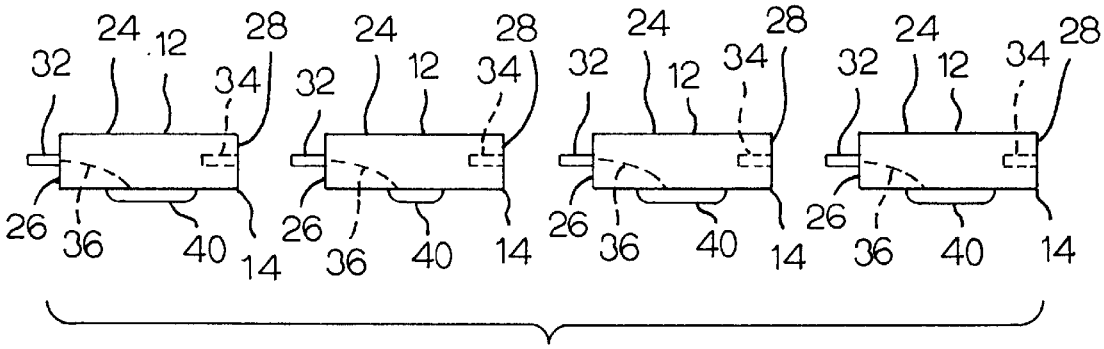
FIG. 4 is a top view of a plurality of separated modules in accordance with the present invention.

Referring now to FIGS. 2–4, in the preferred embodiment shown, each of the modules 12 has a box-like shape, although other shapes are certainly possible without departing from the spirit and scope of the present invention. The walls of the individual modules 12 are preferably constructed of thin sheets of metal or a similar weather resistant material that allow the modules 12 to maintain their structural integrity and provide support for a light load-bearing front wall 14, said front wall 14 preferably being readily detachable from the remainder of the module 12. In this regard, any appropriate fastener may be used to detachably connect the front wall 14 to the remainder of the module 12. For example, one preferred technique would be to provide for a snap fitting in which the front wall 14 is pressed into a clamp configuration formed in the top and bottom walls. In this manner, the interior of the housing formed by the modules 12 can be readily accessed as desired.

Each of the modules 12 may be separately attached to the surface 10*a* of the billboard 10 (as depicted in FIG. 1), by any appropriate fasteners such as, for example, wood or metal screws 30 securing the back wall 24 of the module 12 to the surface 10*a* of the billboard 10, as best shown in FIGS. 2 and 3. However, because the modules 12 are juxtaposed together to form a matrix 15 of modules 12 on the billboard surface 10*a*, it is possible that only certain modules are actually secured to the billboard 10 with the remaining modules attached directly or indirectly to the secured modules. In this regard, module-to-module attachment can accomplished by numerous and different fasteners. As best illustrated in FIG. 4, one preferred technique is to combine the requisite electrical and physical connections through prong and slot, connections. Specifically, each of the modules 12 may be provided with a double or triple prong 32 extending out from a respective side wall 26 and in registry with a slot opening 34 in an opposite and facing side wall 28 of a neighboring module. As will be discussed below, the modules 12 house internal wiring 36 and other electrical accessories (not shown) that electrically connect the various illuminating devices 40 that may be secured to the front surface of the modules 12.

Referring again to FIG. 1, in this example, it may be seen that an illuminating device 40 is comprised of block letter writing "DRINK COLA." It should be understood that the particular advertising display is but one example of an outdoor illuminated advertising display in accordance with the present invention. The advertising display could be an illuminated indicia or design of any type and could be combined with indicia and/or designs 16 printed directly on the front surfaces of the respective modules 12. For the sake of simplicity and clarity, each module 12 is shown bearing a single block letter, but script writing or a design could be used as well, with the letters or designs actually bridging various modules. Moreover, it is contemplated that a single module could support an entire word or design. For example, a single module could support the word "DRINK" in script form.

Referring still to the particular example illustrated in FIG. 1, the modules 12 must be assembled on the surface 10*a* of the billboard 10 in the correct sequence to form the proper matrix 15 of modules 12. While the dimensions of the modules 12 are not an essential component of the invention, it is desirable that the size and thickness of the modules 12 be adequate to facilitate assembly, disassembly, and portability. For example, it is contemplated that the thickness of each module will likely not exceed about 2 inches.

Figure 5:
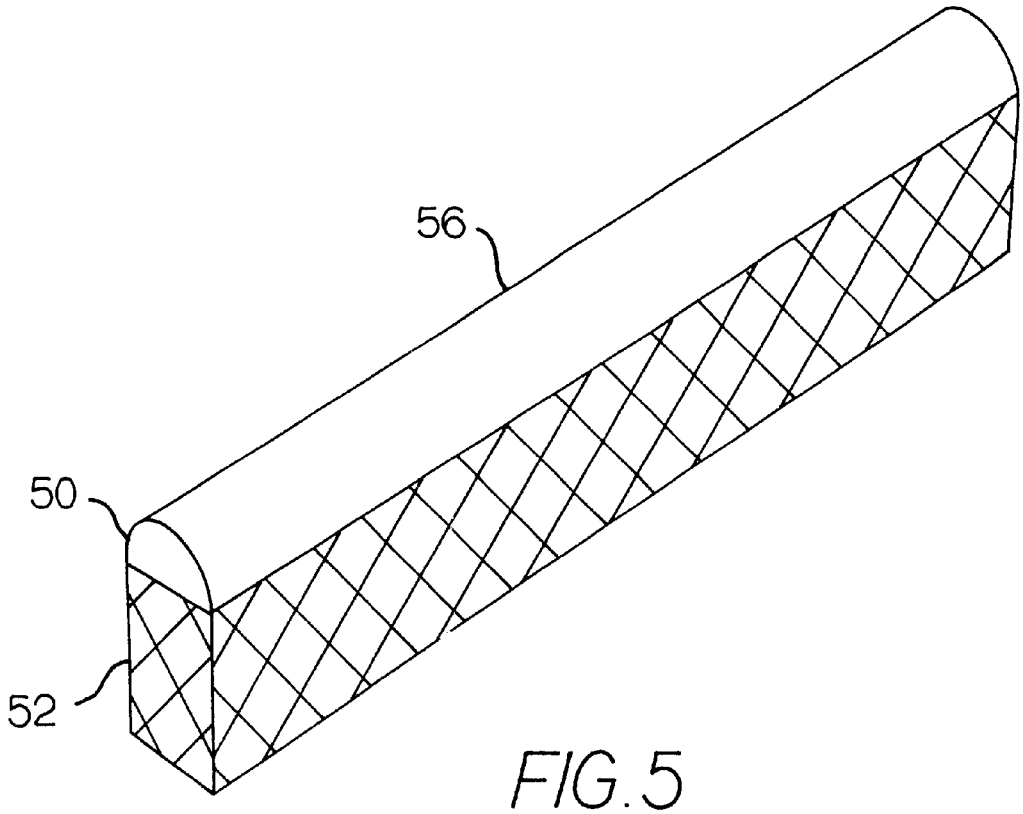
FIG. 5 is a perspective view of a illumination device preferably incorporated into a preferred advertising display in accordance with the present invention.
Figure 6:
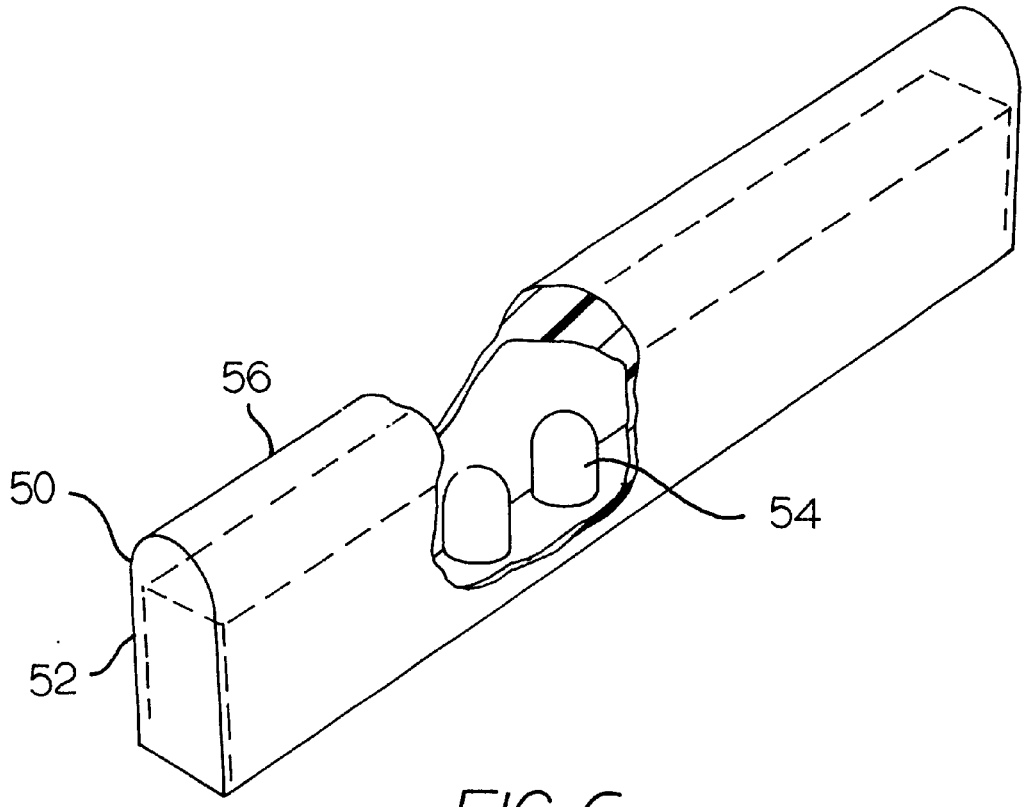
FIG. 6 is a perspective view similar to FIG. 5, partially broken away to show the LED light sources in this preferred embodiment.

The illumination devices 40 for incorporation into the advertising displays of the present invention are the lightweight illumination devices described and claimed in the commonly owned and co-pending U.S. patent application Ser. No. 09/982,705 filed Oct. 18, 2001. This co-pending application is incorporated herein by reference for its detailed description of such illumination devices. Briefly, however, the illumination devices 40 are preferably comprised of a waveguide 50 connected to a housing 52 and including a series of point light sources 54, such as high intensity light emitting diodes ("LEDs"), mounted adjacent a light receiving surface of the waveguide 50, as illustrated in FIGS. 5 and 6. A light-emitting, lateral surface 56 of the waveguide 50 provides a light intensity pattern that is substantially uniform along its length, thereby providing illumination substantially similar to that of a neon tube. Of course, as stated in the co-pending application, the waveguides 50 and associated housings 52 are cool to the touch during illumination, and the material from which the waveguides 50 are constructed allows for formation of designs, script writing, or block letters with relative ease. Moreover, the resultant illumination devices use much less electrical energy, and are rugged and lightweight, thus making such devices ideally suited for incorporation into the advertising displays of the present invention.

Although the illumination devices described and claimed in the commonly owned and co-pending U.S. patent application Ser. No. 09/982,705 are ideally suited for use with the present invention, it is important to recognize that other illumination devices, including incandescent lamps, fluorescent light, and even some forms of neon lighting, could be incorporated into the present invention with departing from the spirit and scope of the present invention.

Fastening the illumination devices 40 to the surfaces of the individual modules 12 presents little challenge and can easily be accomplished in an unobtrusive fashion using common fasteners and/or adhesives. As shown in FIG. 3, for example, the lighting device is secured to the front wall 14 of the module 12 with a layer of water and weather resistant adhesive 38.

Finally, as mentioned above, each of the modules 12 preferably houses certain electrical wiring and accessories that may be connected to any independent illuminating device 40 that may be fixed to the front wall 14 thereof. Thus, for example, the entire word "COLA" may be connected to a single power source independent of the word "DRINK" through the electrical interlocking of the respective modules 12. In such a manner, the word "DRINK" could be connected to various devices to permit intermittent flashing of that word while the word "COLA" is illuminated with constant intensity. Of course, many different illuminating sequences could be designed and employed as desired. Depending upon the sequence and/or effect desired, the illuminating devices 40 could be connected in series or parallel. In the example depicted in FIG. 4, a simple series connection is employed with each module 12 and its associated illumination device 40 being electrically connected to adjacent modules 12. Other accessories could be added as desired including AC-DC adapters and controllers of all types for the lighting sequences.

Figure 7:
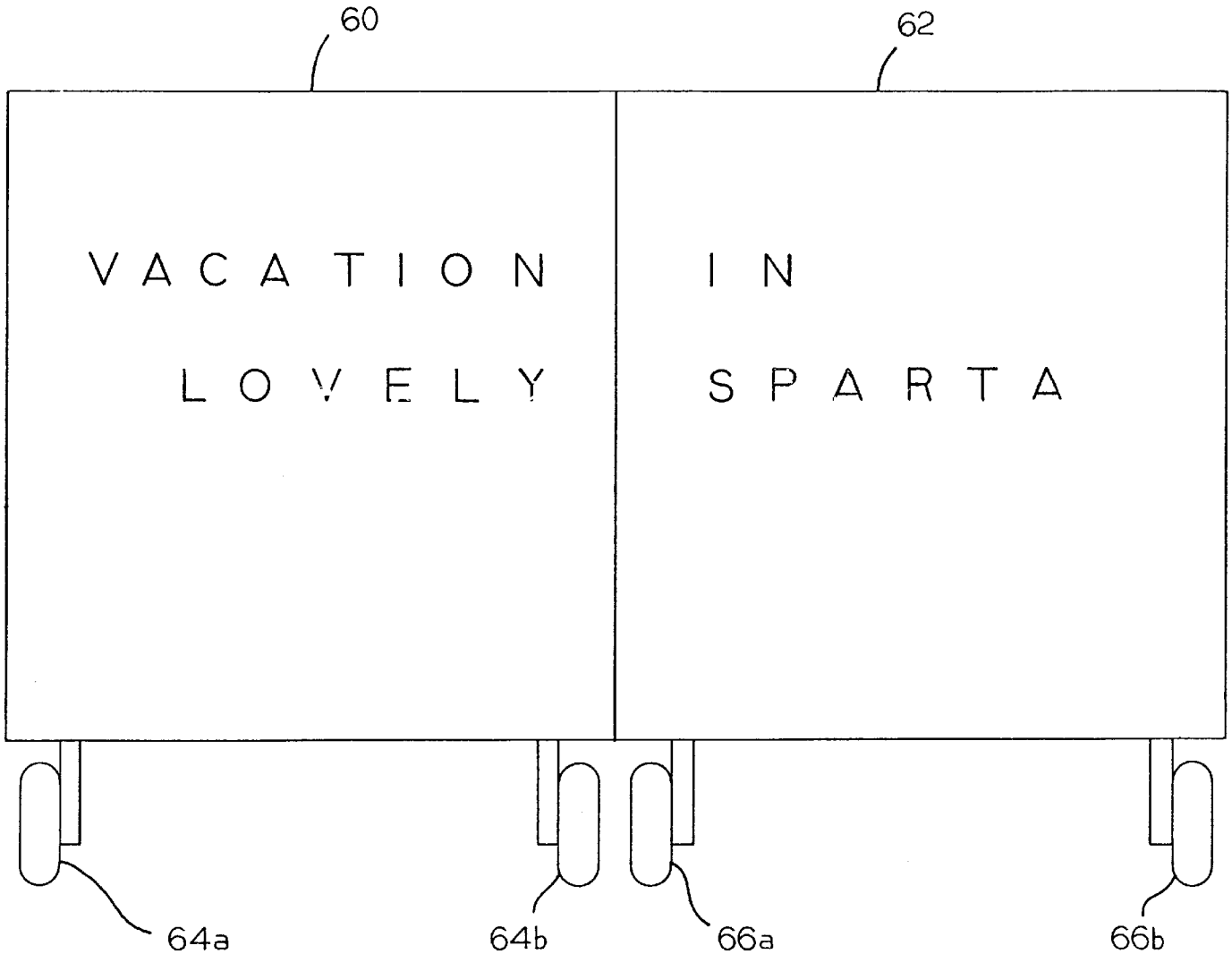
FIG. 7 is a view of two separate frame structures positioned side-by-side to create an advertising display in accordance with the present invention.

As a final note, although the above description describes independent modules 12 collectively forming a matrix of modules when juxtaposed adjacent one another in predetermined positions with respect to a frame structure, it is also understood that a plurality of matrices or billboards could be positioned adjacent one another to create the total advertising display. For example, FIG. 7 illustrates two separate billboard sections 60, 62 positioned side-by-side and supported by rollers 64*a*, 64*b*, 66*a*, 66*b* to create an advertising display. Each of the billboard sections 60, 62 includes one or more illumination devices secured to the surface thereof. In this example, each letter of the phrase "VACATION IN LOVELY SPARTA" could be an independent module and illumination device, or each word could be an independent module and illumination device, or the first billboard section 60 could be one module and illumination device with the second billboard section 62 being a second module and illumination device It will be obvious to those skilled in the art that other modifications may be made to the invention as described herein without departing from the spirit and scope of the present invention.

What is claimed is:

1. A portable outdoor advertising display adapted to be secured to a frame structure, comprising:

a plurality of modules, a portion of which are removably secured to said frame structure, collectively forming a matrix of modules when juxtaposed adjacent one another in predetermined positions on a surface of the frame structure;

an illumination device secured to at least one of the modules and forming a visually apparent indicia or a design when said modules are in said predetermined positions; and indicia in the form of printed subject matter secured to a surface of one or more of the modules, thereby forming a completed advertising display with said illumination devices.

2. The advertising display of claim 1, in which at least two separate illumination devices are secured to respective modules.

3. The advertising display of claim 1, in which said modules each house electrical components that are placed into electrical communication when said modules are in said predetermined positions.

4. The advertising display of claim 3, in which each said illumination device is comprised of a waveguide with high intensity light-emitting diodes adjacent a light receiving surface of said waveguide for emission of light out of a lateral surface of said waveguide.

5. A removable outdoor advertising display in combination with a stationary frame structure, comprising:

a plurality of modules removably secured among one another and forming a matrix of modules when secured to said frame in predetermined positions;

illumination devices secured to at least two of the modules and juxtaposed together when said modules are in position and forming a visually apparent indicia or a design; and indicia in the form of printed subject matter secured to a surface of one or more of the modules and forming a visually apparent indicia or a design.

6. A portable outdoor advertising display adapted to be secured to a frame structure, comprising:

a plurality of modules, a portion of which are removably secured to said frame structure, collectively forming a matrix of modules when juxtaposed adjacent one another in predetermined positions on a surface of the frame structure; and an illumination device secured to at least one of the modules and forming a visually apparent indicia or a design when said modules are in said predetermined positions, wherein said illumination device is comprised of a waveguide with a series of point light sources mounted adjacent a light receiving surface of the waveguide for emission of light out of a lateral surface of said waveguide.

7. A portable outdoor advertising display as recited in claim 6, in which the point light sources of said waveguide are high intensity light emitting diodes.

8. The advertising display of claim 6, including indicia in the form of printed subject matter secured to a surface of one or more of the modules, thereby forming a completed advertising.

* * * * *